US007435139B2

(12) United States Patent
Yang

(10) Patent No.: US 7,435,139 B2
(45) Date of Patent: Oct. 14, 2008

(54) ELECTRICAL CONNECTOR HAVING IMPROVED SHIELD

(75) Inventor: Meng-Huan Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/732,627

(22) Filed: Apr. 3, 2007

(65) Prior Publication Data

US 2007/0232143 A1 Oct. 4, 2007

(30) Foreign Application Priority Data

Apr. 3, 2006 (TW) ..... 95205559 U

(51) Int. Cl.
*H01R 13/648* (2006.01)

(52) U.S. Cl. ..... 439/607

(58) Field of Classification Search ..... 439/607, 439/609

See application file for complete search history.

(56) References Cited

U.S. PATENT DOCUMENTS 6,435,882 B1 * 8/2002 Pitou ..... 439/70
6,862,804 B2 * 3/2005 Nishio et al. ..... 29/840
6,905,344 B2 * 6/2005 Nishio et al. ..... 439/68
6,939,172 B2 * 9/2005 Lu ..... 439/607
7,029,308 B2 * 4/2006 Wada ..... 439/330
7,077,663 B2 * 7/2006 Nishio et al. ..... 439/70
7,077,664 B1 * 7/2006 Wang et al. ..... 439/70
7,077,680 B1 * 7/2006 Wang et al. ..... 439/331
7,086,902 B1 * 8/2006 Yang ..... 439/607
7,097,466 B2 * 8/2006 Asai ..... 439/76.1
7,112,083 B2 * 9/2006 Nishio et al. ..... 439/331
7,121,864 B1 * 10/2006 Yang ..... 439/331
7,128,607 B2 * 10/2006 Li ..... 439/607
7,147,481 B2 * 12/2006 Yang ..... 439/71
7,156,679 B1 * 1/2007 Wang et al. ..... 439/330
7,160,116 B2 * 1/2007 Li ..... 439/73
7,163,407 B2 * 1/2007 Nishio et al. ..... 439/70
7,168,959 B2 * 1/2007 Kuo et al. ..... 439/67
7,179,126 B2 * 2/2007 Chen ..... 439/607
7,214,083 B2 * 5/2007 Chen et al. ..... 439/330
7,226,297 B2 * 6/2007 Li ..... 439/71
7,232,316 B2 * 6/2007 Chen ..... 439/71
7,241,160 B2 * 7/2007 Yang ..... 439/330
7,255,600 B2 * 8/2007 Ma ..... 439/607
7,261,597 B2 * 8/2007 Li ..... 439/607
7,261,599 B2 * 8/2007 Li ..... 439/608
7,281,954 B1 * 10/2007 Hashiguchi et al. ..... 439/660
7,288,003 B2 * 10/2007 Ono et al. ..... 439/607

(Continued)

FOREIGN PATENT DOCUMENTS

CN 2733635 Y 10/2005

*Primary Examiner*—Ross N Gushi
(74) *Attorney, Agent, or Firm*—Wei Te Chung

(57) ABSTRACT

An electrical connector (5) for receiving an electrical element (6) includes an insulative housing (51), a shield (53) enclosing the insulative housing and a number of terminals (52) received in the insulative housing. The insulative housing has a bottom wall (510), a number of periphery walls (511), and a receiving space (100) defined therebetween. The shield includes a number of separated side walls (530) each defining a pair of slots (5309), a connecting portion (5311) between the pair of slots, and a fixing portion (5306) extending inwardly from the connecting portion for guiding and fastening the electrical element.

10 Claims, 6 Drawing Sheets

U.S. PATENT DOCUMENTS 7,309,238 B2 * 12/2007 Yang ..... 439/71
2003/0218873 A1 * 11/2003 Eormaki et al. ..... 361/816
2004/0023528 A1 * 2/2004 Nishio et al. ..... 439/70
2004/0068868 A1 * 4/2004 Nishio et al. ..... 29/840
2004/0247311 A1 * 12/2004 Ajiki et al. ..... 396/535
2005/0048829 A1 * 3/2005 Nishio et al. ..... 439/331
2005/0060842 A1 * 3/2005 Ibaraki et al. ..... 16/295
2005/0153600 A1 * 7/2005 Lu ..... 439/607
2005/0215087 A1 * 9/2005 Asai et al. ..... 439/71
2005/0215117 A1 * 9/2005 Asai et al. ..... 439/607
2005/0215118 A1 * 9/2005 Asai et al. ..... 439/607
2005/0239302 A1 * 10/2005 Wada ..... 439/71
2006/0014405 A1 * 1/2006 Chen et al. ..... 439/78
2006/0063431 A1 * 3/2006 Yang ..... 439/607
2006/0105631 A1 * 5/2006 Yang ..... 439/607
2006/0189179 A1 * 8/2006 Dittmann et al. ..... 439/74
2006/0189216 A1 * 8/2006 Yang ..... 439/680
2006/0216996 A1 * 9/2006 Chen ..... 439/607
2006/0234557 A1 * 10/2006 Chen ..... 439/609
2006/0258218 A1 * 11/2006 Chen ..... 439/607
2006/0258219 A1 * 11/2006 Chen ..... 439/607
2006/0270274 A1 * 11/2006 Li ..... 439/581
2006/0270276 A1 * 11/2006 Li ..... 439/607
2007/0037448 A1 * 2/2007 Ma ..... 439/607
2007/0238357 A1 * 10/2007 Wang ..... 439/607

* cited by examiner

ELECTRICAL CONNECTOR HAVING IMPROVED SHIELD

BACKGROUND OF THE INVENTION

1. Field of the Invention

The present invention relates to a shielded electrical connector, and particularly to a shielded electrical connector in which an electrical element such as a camera module is fitted.

2. Description of Prior Arts

With development of miniature and multifunctional electronic devices, consumer electronics such as cell phone, Personal Digital Assistant etc., are designed to provide a camera module in virtue of an electrical connector. Generally, a shield member is assembled to the electrical connector to reduce EMI (electromagnetic interference).

A conventional electrical connector for receiving a camera module is described in Chinese Patent No. CN2733635Y issued on Oct. 12, 2005. The electrical connector comprises a shield, an insulative housing and a plurality of terminals mounted in a plurality of periphery walls of the insulative housing. The shield surrounds the insulative housing and comprises four side walls stamped from a punched metal sheet. Each side wall has a locking portion extending horizontally from an upper portion thereof and a ground plate extending downwardly therefrom and projecting inwardly not only for grounding the camera module but also for resisting against the camera module.

However, it is so complicated to manufacture the shield as a whole that it would result in poor dimensional precision. Additionally, the shield described above could not provide sufficient resilient force to resist against the camera module firmly.

Hence, it is desirable to provide an improved electrical connector to overcome the aforementioned disadvantages.

SUMMARY OF THE INVENTION

An object of the present invention is to provide an electrical connector having an improved shield for firmly fastening an electrical element.

To achieve the above object, an electrical connector for receiving an electrical element comprises an insulative housing, a shield and a plurality of terminals received in the insulative housing. The insulative housing has a bottom wall, a plurality of periphery walls, and a receiving space defined therebetween for receiving the electrical element. The shield encloses the insulative housing and comprises a plurality of separated side walls each having a pair of slots paralleled, a connecting portion between the pair of slots and a fixing portion extending into the receiving space from the connecting portion.

Advantages of the present invention are to provide a shield having four separated side walls for simplifying the process of manufacturing the shield and improving the precision of the shield in size. Additionally, the fixing portions of the shield provide sufficient resilient force to resist against the electrical element firmly.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
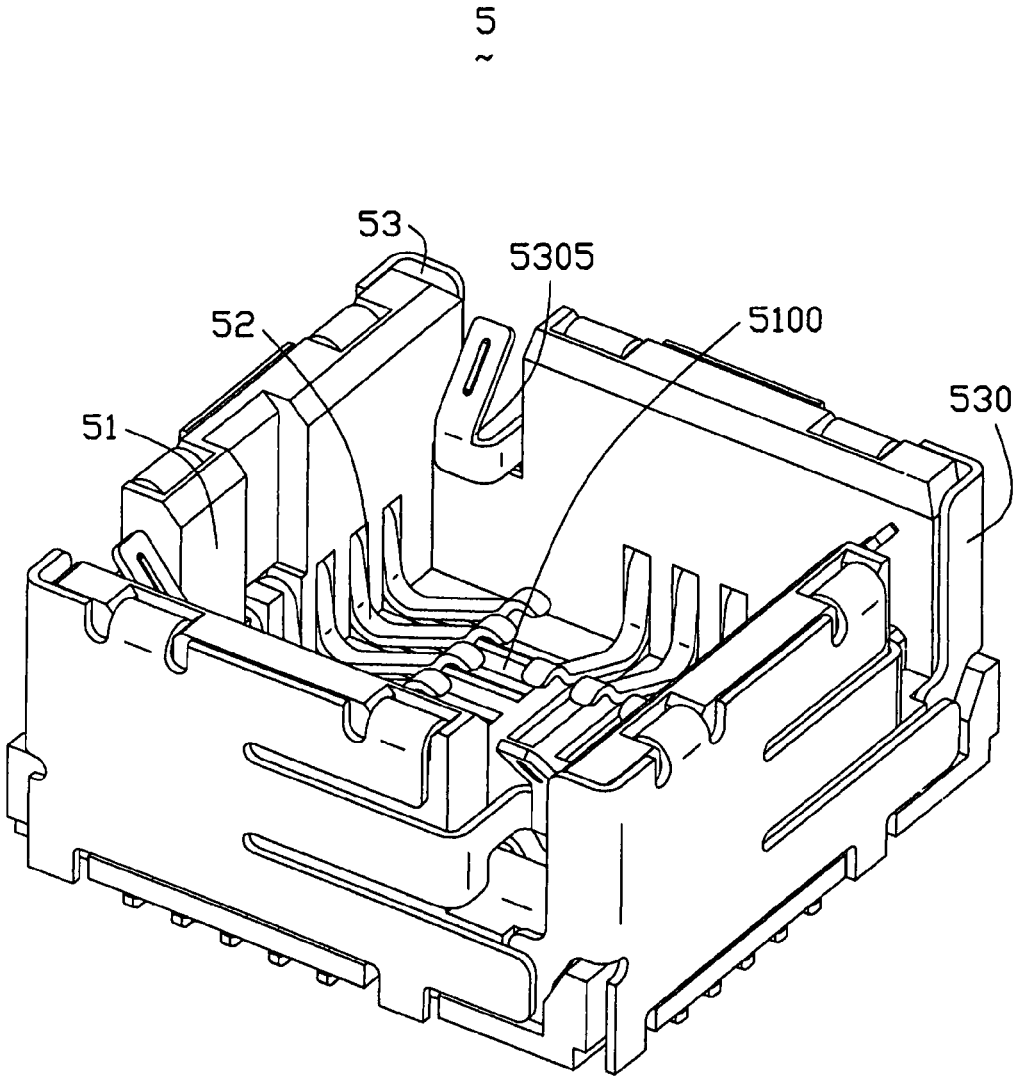
FIG. 1 is an assembled perspective view of an electrical connector in accordance with the present invention.
Figure 2:
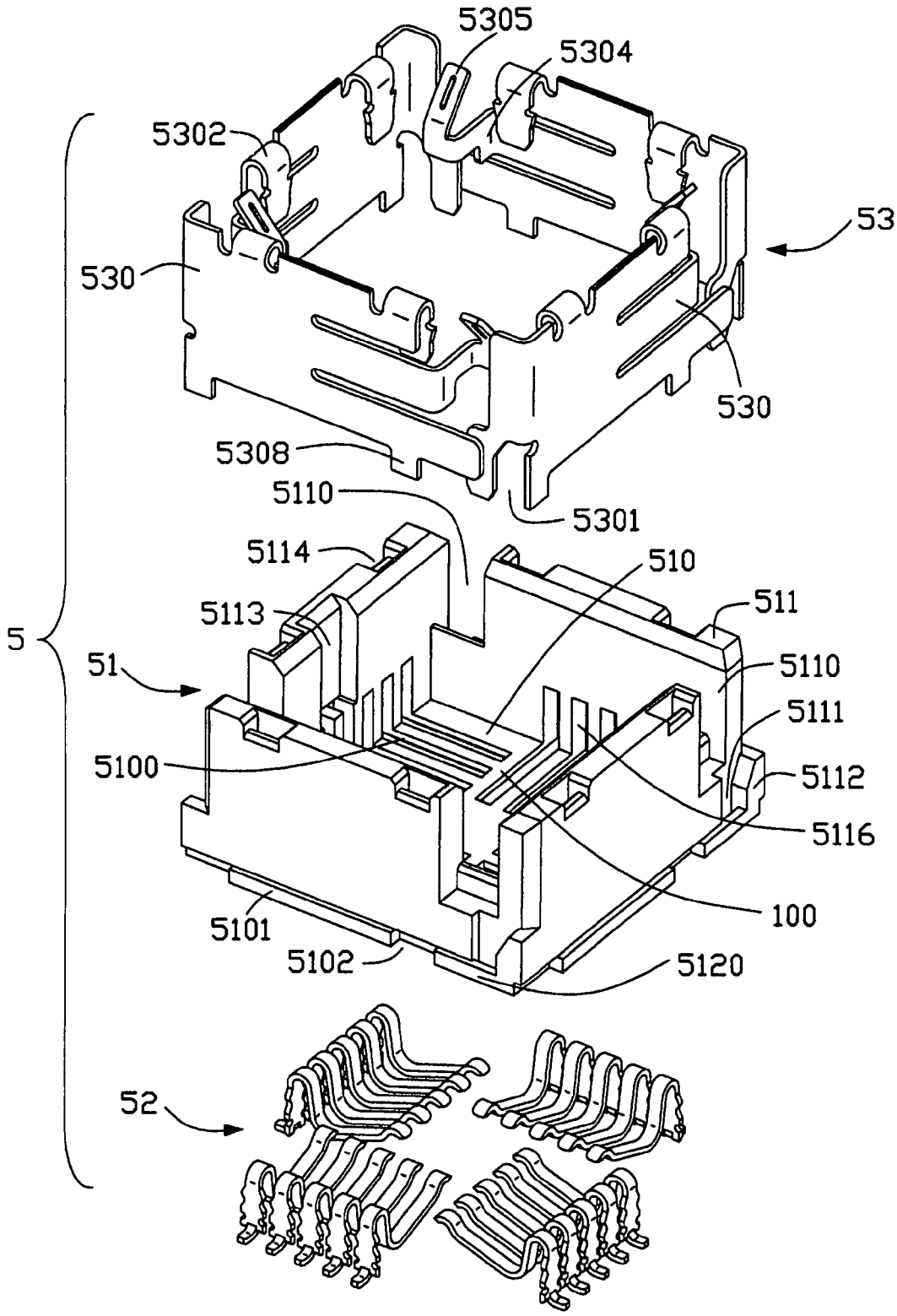
FIG. 2 is an exploded perspective view of the electrical connector as shown in FIG. 1.
Figure 3:
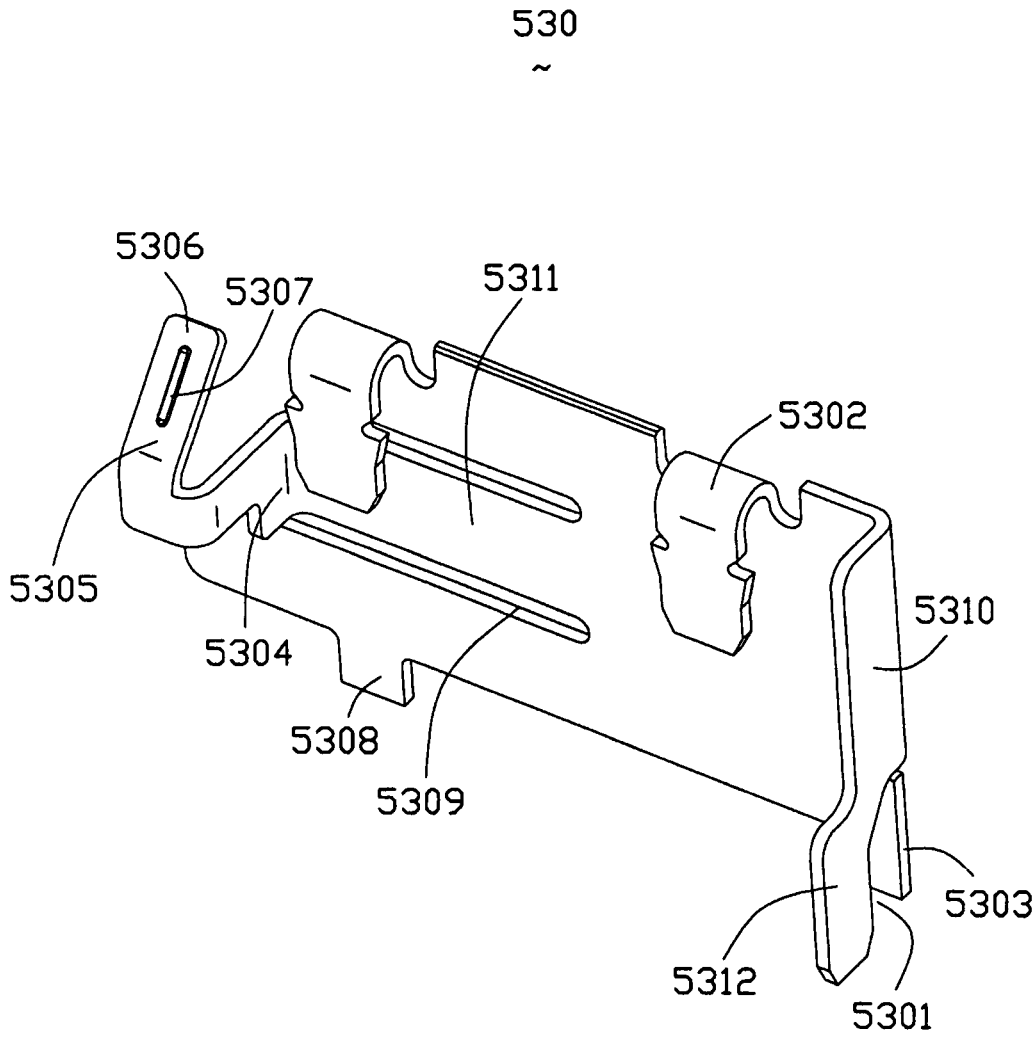
FIG. 3 is a perspective view of a side wall of a shield.
Figure 4:
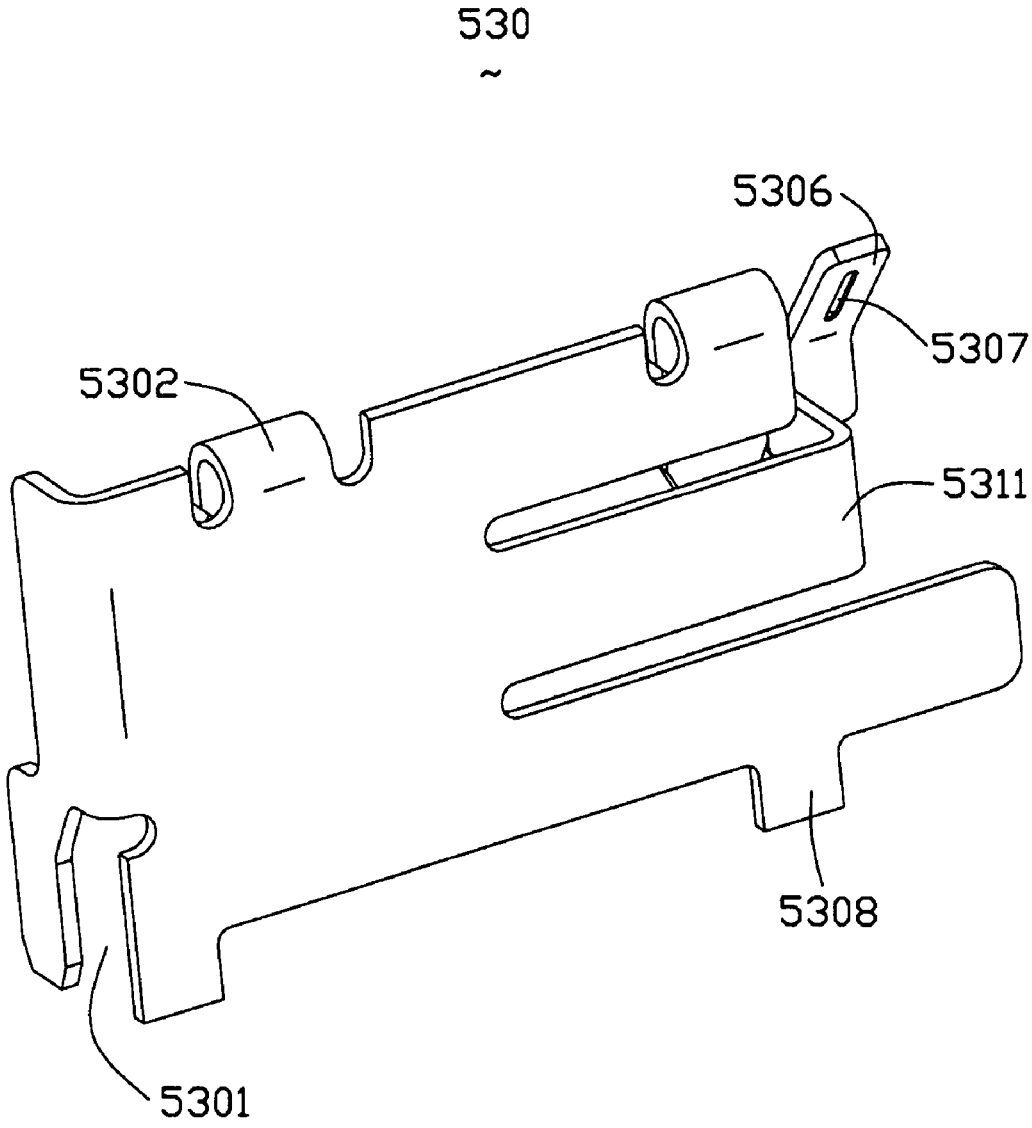
FIG. 4 is another perspective view of the side wall as shown in FIG. 3.

Reference will now be made to the drawing figures to describe the present invention in detail. Referring to FIGS. 1-6, an electrical connector 5 in accordance with the present invention is adapted for firmly fastening an electrical element. The electrical element referred to in this embodiment is a camera module 6. The electrical connector 5 comprises an insulative housing 51, a plurality of terminals 52 and a shield 53 surrounding the insulative housing 51.

The insulative housing 51 has a rectangular bottom wall 510, four periphery walls 511 and a receiving space 100 defined therein. Each periphery wall 511 defines a plurality of first passageways 5116 thereon for communicating with corresponding second passageways 5100 defined on the bottom wall 510 for receiving the terminals 52. The insulative housing 51 comprises a recess 5111 defined at each corner thereof for engaging with the shield 53 and a projecting portion 5112 adjoining the recess 5111. A depression 5113 is defined on a middle portion of an inner surface of one of the periphery walls 511 for engaging with a protruding portion (not shown) of the camera module 6. Each periphery wall 511 is provided with a pair of cutouts 5114 each extending in a top-to-bottom direction from a top portion thererof. The rectangular bottom wall 510 has a pair of protruding portions 5101, 5120 extending outwardly from each edge and a groove 5102 defined between the pair of protruding portions 5101, 5120 for receiving a soldering portion 5308 extending downwardly from a lower portion of the shield 53.

The shield 53 comprises four separated side walls 530 stamped from metal material. Each side wall 530 comprises a protruding blade 5310 bent inwardly from a side edge thereof. The protruding blade 5310 comprises a downwardly extending foot portion 5312 for engaging with the recess 5111 and an indentation 5301 defined between the foot portion 5312 and a lower portion of the side wall 530 for receiving the projecting portion 5112. Each side wall includes a second soldering portion 5303 below the protruding blade 5310. The side wall 530 further defines thereon a pair of open slots 5309 paralleled with each other to form a connecting portion 5311 between the pair of slots 5309 and a fixing portion 5306 bent inwardly from the connecting portion 5311. The fixing portion 5306 is adopted for resisting against the camera module 6 and has a L-shaped vertical portion 5304 bent inwardly vertically from the connecting portion 5311 and a guiding wall 5305 obliquely upwardly extending from the vertical portion 5304. The guiding wall 5305 has a slick surface and an arced protrusion 5307 disposed on the slick surface for guiding the camera module 6. Each side wall 530 further comprises a pair of locking portions 5302 bent downwardly from a top portion thereof and received in corresponding cutouts 5114 of the insulative housing 51 for firmly fastening the shield 53 to the insulative housing 51.

Figure 5:
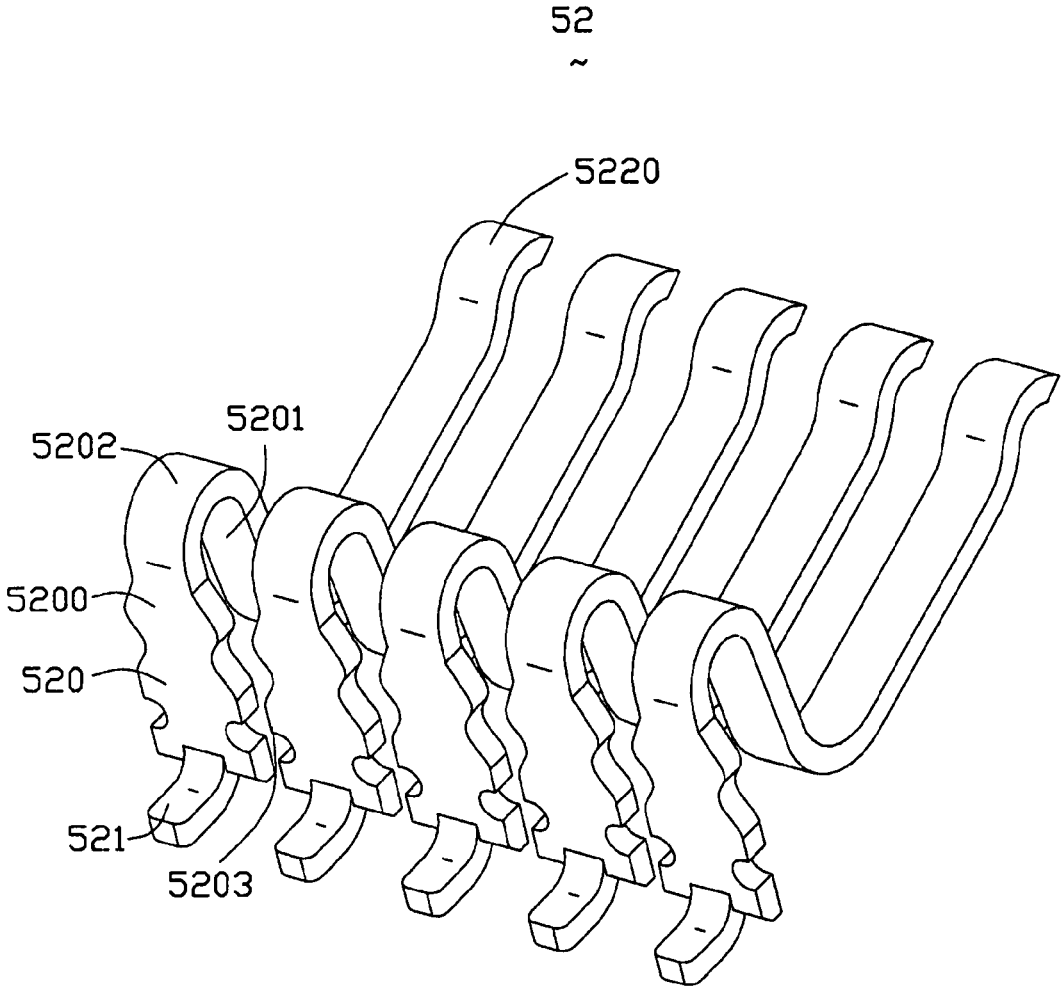
FIG. 5 is a perspective view of a plurality of terminals.
Figure 6:
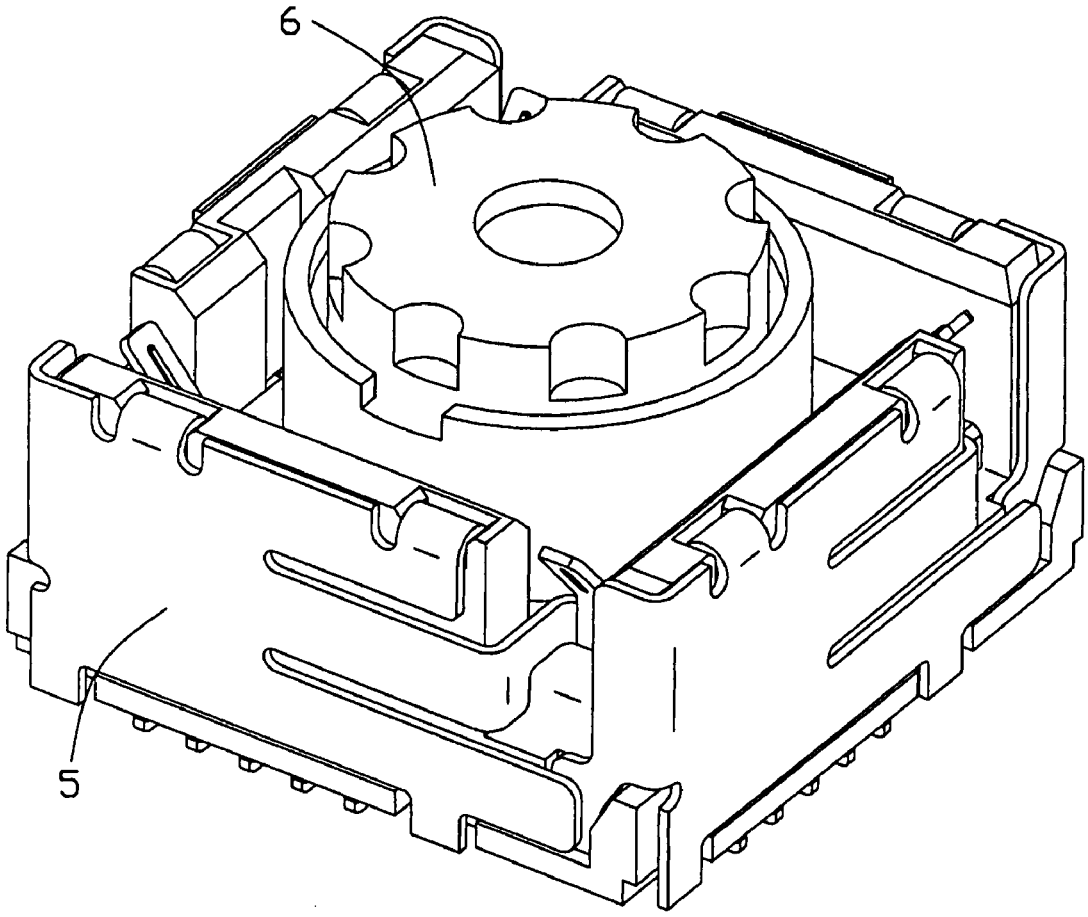
FIG. 6 is an assembled perspective view of the electrical connector with an electrical element retained therein.

Referring to FIG. 5, the terminal 52 comprises a U-shaped base potion 520 having a first bending portion 5201, an opposite second bending portion 5200 and a middle portion 5202 for connecting with the first bending portion 5201 and the second bending portion 5200. The terminal 52 has a contacting portion 5220 extending from the first bending portion 5201 for electrically resisting against a pad (not shown) disposed below the camera module 6 and a soldering portion 521 extending from the second bending portion 5200 for connecting with a printed circuit board (not shown). The terminal 52 has one or more barbs 5203 on the second bending portion 5200 for firmly engaging with the first passageways 5116.

In assembling of the electrical connector 5, firstly, the terminals 52 are received in the first passageways 5116 and the second passageways 5100. Secondly, the shield 53 encloses the insulative housing 51, with the locking portions 5302 of the shield 53 inserted into the corresponding cutouts 5114 of the insulative housing 51. The fixing portion 5306 extends toward the receiving space 100 through a corresponding indentation 5110 of the insulative housing 51.

When the camera module 6 is guided in, the fixing portions 5306 of the side walls 530 are pressed and deflected outwardly. The camera module 6 could be guided into receiving space 100 easily via the arced portion 5307 and the slick surface of the guiding wall 5305. When the camera module 3 is completely inserted in, the L-shaped vertical portions 5304 firmly abut against the camera module 6. At the same time, the contacting portions 5220 of terminals 52 are electrically resisting against the pads of the camera module 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for receiving an electrical element, comprising:

an insulative housing having a bottom wall, a plurality of periphery walls upstanding from the bottom wall, and a receiving space defined therein for receiving the electrical element;

a plurality of terminals received in the insulative housing; and a shield comprising a plurality of separated side walls each engaging with a corresponding periphery wall, each side wall defining a pair of slots, a connecting portion between the pair of slots, and a fixing portion extending inwardly from the connecting portion into the receiving space;

wherein said fixing portion comprises an L-shaped vertical portion bent inwardly from the connecting portion and a guiding wall obliquely upwardly bent from the vertical portion.

2. The electrical connector as claimed in claim 1, wherein said guiding wall comprises a slantwise slick face and an arced protrusion formed on the slick face for easing insertion of the electrical element.

3. The electrical connector as claimed in claim 1, wherein the periphery wall of said insulative housing comprises a pair of cutouts formed on a top portion thereof, and wherein the side wall of the shield has a pair of locking portions bent downwardly from a top portion thereof and received in the pair of cutouts for fastening the shield to the insulative housing.

4. The electrical connector as claimed in claim 1, wherein each periphery wall has a plurality of first passageways and with the bottom wall has a plurality of second passageways cooperating with the first passageways for receiving the terminals.

5. The electrical connector as claimed in claim 1, wherein said bottom wall comprises a pair of protruding portions extending outwardly from each edge, and a groove defined between the pair of protruding portions for receiving a soldering portion extending downwardly from a lower portion of each side wall of the shield.

6. The electrical connector as claimed in claim 1, wherein said side wall of the shield comprises a protruding blade bent inwardly from a side edge thereof for engaging the periphery wall.

7. The electrical connector as claimed in claim 6, wherein said protruding blade comprises a downwardly extending foot portion and an indentation defined between the foot portion and a lower portion of the side wall, and wherein the insulative housing, has a recess defined at each corner portion thereof for engaging with the foot portion.

8. An electrical connector comprising:

an insulative housing having a plurality of upstanding exterior side faces with a receiving space defined therein for receiving the electrical element;

each of said faces defining a cutout;

a plurality of terminals located around a bottom portion of the receiving space; and a shield comprising a plurality of side plates respectively attached upon the corresponding side faces, each of said side plates defining a resilient arm extending in a non-vertical manner so as to obtain a superior length thereof and a fixing portion located at a free end thereof; wherein said fixing portion extends through the corresponding cutout and defines a downward L-shaped edge section for locking a camera module thereunder.

9. The electrical connector as claimed in claim 8, wherein said spring arm extends horizontally.

10. An electrical connector for receiving an electrical element, comprising:

an insulative housing having a bottom wall, a plurality of periphery walls upstanding from the bottom wall, and a receiving space defined therein for receiving the electrical element;

a plurality of terminals received in the insulative housing; and a shield comprising a plurality of separated side walls each engaging with a corresponding periphery wall, each side wall defining a pair of slots, a connecting portion between the pair of slots, a fixing portion extending inwardly from the connecting portion into the receiving space, and at least one locking portion bent downwardly from a top edge thereof and received in a cutout, formed on a top portion of the periphery wall for fastening the shield to the insulative housing.

* * * * *